US009864293B2

(12) United States Patent
Hasegawa et al.

(10) Patent No.: US 9,864,293 B2
(45) Date of Patent: Jan. 9, 2018

(54) ELECTROSTATIC CHARGE IMAGE DEVELOPING CARRIER, METHOD OF PREPARING ELECTROSTATIC CHARGE IMAGE DEVELOPING CARRIER, AND ELECTROSTATIC CHARGE IMAGE DEVELOPER

(71) Applicant: FUJI XEROX CO., LTD., Tokyo (JP)

(72) Inventors: Toshiaki Hasegawa, Kanagawa (JP); Takashi Tanabe, Kanagawa (JP); Masaaki Usami, Kanagawa (JP); Yasunobu Kashima, Kanagawa (JP); Takeshi Iwanaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/223,771

(22) Filed: Jul. 29, 2016

(65) Prior Publication Data

US 2017/0255120 A1 Sep. 7, 2017

(30) Foreign Application Priority Data

Mar. 2, 2016 (JP) ..... 2016-039881

(51) Int. Cl.

| | |
|---|---|
| ***G03G 9/00*** | (2006.01) |
| ***G03G 9/113*** | (2006.01) |
| ***G03G 9/107*** | (2006.01) |
| ***G03G 9/08*** | (2006.01) |

(52) U.S. Cl.

CPC ..... *G03G 9/1133* (2013.01); *G03G 9/0808* (2013.01); *G03G 9/0819* (2013.01); *G03G 9/1075* (2013.01)

(58) Field of Classification Search

CPC .. G03G 9/1133; G03G 9/1075; G03G 9/0808; G03G 9/0819

See application file for complete search history.

(56) References Cited

U.S. PATENT DOCUMENTS

| | | | | |
|---|---|---|---|---|
| 5,631,116 | A | 5/1997 | Uchida et al. | |
| 2014/0370432 | A1* | 12/2014 | Veregin ..... | G03G 9/1138 430/108.7 |

FOREIGN PATENT DOCUMENTS

| | | | |
|---|---|---|---|
| JP | H07-114219 | A | 5/1995 |
| JP | 3691085 | B2 | 8/2005 |
| JP | 2012-194230 | A | 10/2012 |

* cited by examiner

*Primary Examiner* — Thorl Chea

(74) *Attorney, Agent, or Firm* — Oliff PLC

(57) ABSTRACT

An electrostatic charge image developing carrier includes magnetic particles and a resin coating layer which covers the magnetic particles, wherein a sulfate ion concentration of the resin coating layer is 0.05% by weight or less with respect to a total weight of the resin coating layer, and when a total value of a molar amount of sulfate ions contained and a molar amount of sulfo groups contained per 1 g of the resin coating layer is A mol and a molar amount of sodium ions contained per 1 g of the resin coating layer is B mol, a relationship of $0.1<B/A<1.2$ is satisfied.

9 Claims, 2 Drawing Sheets

ELECTROSTATIC CHARGE IMAGE DEVELOPING CARRIER, METHOD OF PREPARING ELECTROSTATIC CHARGE IMAGE DEVELOPING CARRIER, AND ELECTROSTATIC CHARGE IMAGE DEVELOPER

CROSS-REFERENCE TO RELATED APPLICATIONS

This application is based on and claims priority under 35 USC 119 from Japanese Patent Application No. 2016-039881 filed Mar. 2, 2016.

BACKGROUND

1. Technical Field

The present invention relates to an electrostatic charge image developing carrier, a method of preparing an electrostatic charge image developing carrier, and an electrostatic charge image developer.

2. Related Art

Generally, electrostatic charge image developing carriers used for an electrostatic charge image developer are broadly divided into resin-coated carriers in which a resin coating layer of a coating resin is formed on the surface of magnetic particles, and non-coated carriers in which a resin-coated layer is not formed on the surface thereof. In recent years, resin-coated carriers have been frequently used.

SUMMARY

According to an aspect of the invention, there is provided an electrostatic charge image developing carrier including:

magnetic particles; and a resin coating layer which covers the magnetic particles, wherein a sulfate ion concentration of the resin coating layer is 0.05% by weight or less with respect to a total weight of the resin coating layer, and when a total value of a molar amount of sulfate ions contained and a molar amount of sulfo groups contained per 1 g of the resin coating layer is A mol and a molar amount of sodium ions contained per 1 g of the resin coating layer is B mol, a relationship of $0.1<B/A<1.2$ is satisfied.

BRIEF DESCRIPTION OF THE DRAWINGS

Exemplary embodiments of the present invention will be described in detail based on the following figures, wherein.

DETAILED DESCRIPTION

Figure 1:
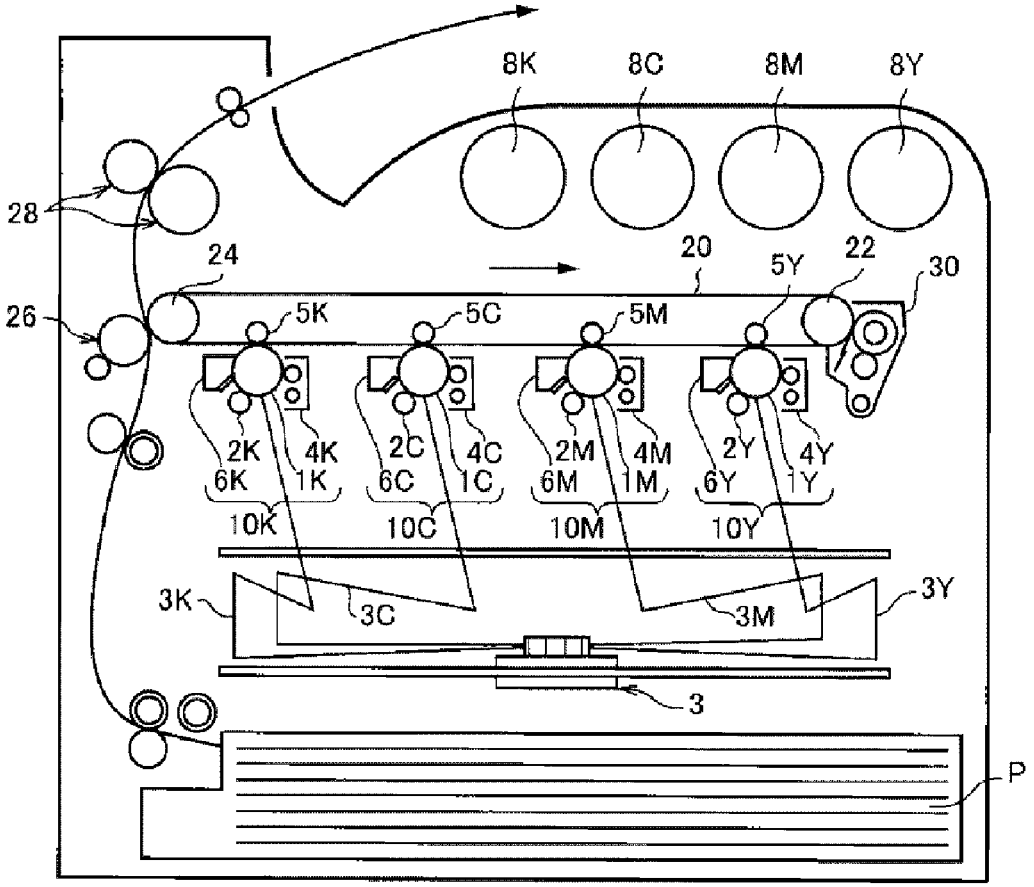
FIG. 1 is a schematic configuration view showing an example of an image forming apparatus suitably used in an exemplary embodiment.

Hereinafter, exemplary embodiments will be described in detail. In the exemplary embodiments, the terms "from A to B" express not only a range between A and B but a range including A and B, each of which is an end thereof.

Further, in the exemplary embodiment, a combination of preferable embodiments is a more preferable embodiment.

Electrostatic Charge Image Developing Carrier

An electrostatic charge image developing carrier according to an exemplary embodiment (hereinafter, also referred to as "carrier") has magnetic particles and a resin coating layer that covers the magnetic particles, a sulfate ion concentration is 0.05% by weight or less with respect to a total weight of the resin coating layer, and when a total value of a molar amount of sulfate ions contained and a molar amount of sulfo groups contained per 1 g of the resin coating layer is A mol, and a molar amount of sodium ions contained per 1 g of the resin coating layer is B mol, a relationship of $0.1<B/A<1.2$ is satisfied.

It is preferable for the carrier used for a developer for image formation by electrophotography to prevent the surface composition or structure from being changed in various environments from the viewpoint of maintaining stable charging performance. Particularly, depending on the humidity environment, the surface composition of the carrier may be changed due to water absorption properties, and thus the electrical resistance and the like may change in some cases.

A method of preventing a change in the water absorbency or structure of the surface by making the structure of the coating resin of the carrier to have a resin composition with hydrophobicity, by adding a hydrophobic additive to the coating resin of the carrier, or the like may be considered.

However, when only the coating resin is treated with a hydrophobizing agent, the carrier loses its conductivity when being stored at low temperature and low humidity for a long period of time and the electrical resistance of the surface of the resin coating layer increases. Contrarily, variations in the electrical resistance are remarkable in some cases. The carrier with an increased electrical resistance as described above prevents development and the printing density of the initial image may be extremely lowered after storage. Accordingly, a method of preventing the electrical resistance of the resin coating layer of the carrier from increasing in the case of in which the carrier is stored at low temperature and low humidity, and preventing the electrical resistance from being lowered by preventing water absorbency at high temperature and high humidity, is demanded.

The present inventors have found that when an electrostatic charge image developing carrier, in which a sulfate ion concentration is 0.05% by weight or less with respect to the total weight of the resin coating layer, and when a total value of the molar amount of sulfate ions contained and the molar amount of sulfo groups contained per 1 g of the resin coating layer is A mol and the molar amount of sodium ions contained therein is B mol, a relationship of $0.1<B/A<1.2$ is satisfied, is used, the initial concentration may be prevented from being lowered after storage at low temperature and low humidity.

Although the detailed mechanism of obtaining the effect is not clear, it is assumed that this is because, when the sulfate ion concentration in the resin coating layer is 0.05% by weight or less, and a relationship of $0.1<B/A<1.2$ is satisfied, the water content in the resin coating layer is appropriate and even in the case of being stored at low temperature and low humidity, the electrical resistance of the carrier is prevented from increasing.

The total value A of the molar amount of sulfate ions contained and the molar amount of sulfo groups contained per 1 g of the resin coating layer and the molar amount B of sodium ions contained preferably satisfy the following expressions:

$$0.001 \text{ mmol}<A<0.01 \text{ mmol and}$$

$$0.001 \text{ mmol}<B<0.01 \text{ mmol.}$$

Hereinafter, the configuration of the carrier according to the exemplary embodiment will be described.

Magnetic Particles

The carrier of the exemplary embodiment contains magnetic particles.

The magnetic particles are not particularly limited and examples thereof include magnetic metal particles such as iron, steel, nickel, or cobalt, magnetic oxide particles such as ferrite or magnetite, and resin-dispersed magnetic particles containing a conductive material and the like dispersed in a matrix resin. Specifically, magnetic particles formed using only a magnetic powder using a magnetic material, magnetic particles obtained by dispersing particles formed of a magnetic powder in a resin, and the like may be used.

Examples of the resin used for the resin-dispersed magnetic particles include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin composed of an organosiloxane bond or a modified product thereof, a fluororesin, polyester, polycarbonate, a phenolic resin, and an epoxy resin, and the resin is not limited to these.

Among these, as the magnetic particles, magnetic oxide particles are preferable and ferrite particles are more preferable.

The volume average particle diameter of the magnetic particles is preferably from 20 μm to 100 μm. When the volume average particle diameter of the magnetic particles is 20 μm or more, in the case in which the carrier is prepared, the carrier is prevented from being developed with a toner. When the volume average particle diameter of the magnetic particles is 100 μm or less, in the case in which the carrier is prepared, a toner may be evenly charged.

The volume average particle diameter d of the magnetic particles may be measured using a laser diffraction/scattering particle diameter distribution meter (LS Particle Size Analyzer: LS13 320, manufactured by Beckman Coulter Inc.). For the size ranges (channels) into which the obtained particle diameter distribution is divided, a volume accumulation distribution is drawn from the smallest particle diameter and the particle diameter at a 50% accumulation is defined as the volume average particle diameter d.

Resin Coating Layer

The electrostatic charge image developing carrier of the exemplary embodiment has a resin coating layer that covers the magnetic particles (hereinafter, also simply referred to as "coating layer").

In addition, the resin coating layer in the exemplary embodiment has a sulfate ion concentration of 0.05% by weight or less with respect to the total weight of the resin coating layer, and when a total value of the molar amount of sulfate ions contained and the molar amount of sulfo groups contained per 1 g of the resin coating layer, is A mol, and the molar amount of sodium ions contained therein is B mol, a relationship of $0.1<B/A<1.2$ is satisfied.

The total weight of the resin coating layer is measured as follows. 5 g of the carrier and 50 g of chloroform are measured by weight and put into to a beaker, the coating resin is dissolved sufficiently with an ultrasonic disperser, the magnetic particles are held with a magnet from the lower portion of the beaker, and a toluene solution in which the resin coating layer is dissolved or dispersed is removed. To the remaining magnetic particles, 50 g of chloroform is further added, the coating resin is further dissolved with an ultrasonic disperser, the magnetic particles are held with a magnet from the lower portion of the beaker, and a toluene solution in which the resin coating layer is dissolved or dispersed is removed again. To the remaining magnetic particles, 50 g of methanol is further added, and the materials are stirred. Then, the magnetic particles are held with a magnet and methanol is discharged. Subsequently, methanol is dried from the beaker. After drying, the weight of the magnetic particles is measured and the total weight of the resin coating layer is obtained from a difference between the weight of the magnetic particles and the weight of the carrier. The sulfate ion concentration is 0.05% by weight or less, preferably 0.04% by weight or less, and more preferably 0.02% by weight or less with respect to the total weight of the resin coating layer.

The lower limit of the sulfate ion concentration is not particularly limited.

The sulfate ion concentration with respect to the total weight of the resin coating layer is measured by putting 5 g of the carrier and 50 g of chloroform into a beaker, sufficiently dissolving the coating resin with an ultrasonic disperser, and separating insoluble portions such as magnetic particles and a conductive material by filtration to obtain a coating resin extract and the like by ion chromatography.

The molar amount of sulfate ions contained and the molar amount of sodium ions contained per 1 g of the resin coating layer, which will be described later, may be measured in the same manner as in the measurement of the sulfate ion concentration.

In the exemplary embodiment, when the total value of the molar amount of sulfate ions contained and the molar amount of sodium ions contained per 1 g of the resin coating layer is A mol, it is preferable that a relationship of $0.001\ \text{mmol}<A<0.01\ \text{mmol}$ is satisfied and it is more preferable that a relationship of $0.001\ \text{mmol}<A<0.007\ \text{mmol}$ is satisfied.

In the exemplary embodiment, when the molar amount of sodium ions per 1 g of the resin coating layer is B mol, it is preferable that a relationship of $0.001\ \text{mmol}<B<0.01\ \text{mmol}$ is satisfied and it is more preferable that a relationship of $0.001\ \text{mmol}<B<0.005\ \text{mmol}$ is satisfied.

In addition, in the exemplary embodiment, a value of B/A preferably satisfies $0.1<B/A<1.2$, more preferably satisfies $0.1<B/A<1.0$, and still more preferably satisfies $0.1<B/A<0.7$.

By setting the value of B/A within the above range, the amounts of components other than sodium sulfate and sodium sulfonate having high water absorbency may be controlled and by adopting a sodium sulfate structure, a hydrate structure is formed and an appropriate amount of water may be maintained at low temperature and low humidity. Thus, it is possible to prevent the initial concentration from being lowered after storage at low temperature and low humidity.

In the exemplary embodiment, the amount of the sulfo groups in the resin coating layer is a total amount including those in which an initiator reactant is attached to the terminals of molecules and those included in the surfactant structure, and the like, and also includes a sulfonate group such as a sodium sulfonate group. The content thereof is measured by, for example, putting 5 g of the carrier and 50 g of chloroform in a beaker, sufficiently dissolving the coating resin with an ultrasonic disperser, separating insoluble portions such as magnetic particles and a conductive material by filtration to obtain a coating resin extract, preparing a measurement sample by drying the extract, and measuring a spectrum of carbon atoms bonded with sulfo groups and sulfonate groups by nuclear magnetic resonance (NMR) spectrometry to obtain the content of the sulfo groups. In addition, the total weight of the resin coating layer is measured by measuring 5 g of the carrier and 50 g of chloroform by weight and putting the materials into a beaker, sufficiently dissolving the coating resin with an ultrasonic disperser, holding the magnetic particles with a magnet from the lower portion of the beaker, and removing a toluene solution in which the resin coating layer is dissolved or dispersed. To the remaining magnetic particles, 50 g of chloroform is further added, the coating resin is further dissolved with an ultrasonic disperser, the magnetic particle are held with a magnet from the lower portion of the beaker, and a toluene solution in which the resin coating layer is dissolved or dispersed is removed again. To the remaining magnetic particles, 50 g of methanol is further added, and the materials are stirred. Then, the magnetic particles are held with a magnet and methanol is discharged. Subsequently, methanol is dried from the beaker. After drying, the weight of the magnetic particles is measured and the total weight of the resin coating layer may be obtained from a difference between the weight of the magnetic particles and the weight of the carrier.

Coating Resin Particles

The resin coating layer in the exemplary embodiment preferably contains coating resin particles.

The coating resin particles are preferably particles formed of the coating resin, which will be described later. As the method of preparing coating resin particles, a method of synthesizing coating resin particles by an emulsion polymerization method, a suspension polymerization method, or the like, or a method of pulverizing and classifying resin after synthesis and emulsifying and dispersing the resin in water to obtain coating resin particles may be used. In the exemplary embodiment, coating resin particles prepared through polymerization and drying by an emulsion polymerization method using a polymerization initiator and a surfactant are preferably used.

In the exemplary embodiment, in the case in which the resin coating layer includes coating resin particles, the coating resin particles may be present in at least a part of the resin coating layer and the coating resin particles may be present to be close to the surface in the resin coating layer. However, it is preferable that the coating resin particles are present to be close to the magnetic particle in the resin coating layer.

The volume average particle diameter of the coating resin particles is preferably from 50 nm to 500 nm and more preferably from 100 nm to 300 nm.

By setting the volume average particle diameter of the coating resin particles within the above range, variations in the thickness of the resin coating layer of the finally obtained carrier are reduced and various additives are dispersed in a satisfactory manner. In addition, the volume average particle diameter is effective in terms of reducing the composition localization inside the resin coating layer of the carrier and variations in performance and reliability. The volume average particle diameter of the coating resin particles may be measured by, for example, cutting the carrier particles with a microtome or the like, and observing fine resin particles remaining in the resin coating layer on the section with a scanning type electron microscope.

Coating Resin

The resin coating layer in the exemplary embodiment preferably contains a coating resin.

It is preferable that the coating resin is a resin not having a cross-linked structure.

The coating resin is not particularly limited and examples thereof include homopolymers or copolymers of styrenes such as styrene, chlorostyrene, and methyl styrene; α-methylene aliphatic monocarboxylic acids such as methyl methacrylate, methyl acrylate, propyl methacrylate, propyl acrylate, lauryl acrylate, cyclohexyl methacrylate, cyclohexyl acrylate, methacrylic acid, acrylic acid, butyl methacrylate, butyl acrylate, 2-ethylhexyl acrylate, and ethyl methacrylate; nitrogen-containing acryls such as dimethylaminoethyl methacrylate; nitriles such as acrylonitrile and methacrylonitrile; vinyl pyridines such as 2-vinyl pyridine and 4-vinyl pyridine; vinyl ethers; vinyl ketones; olefins such as ethylene, propylene, and butadiene; main chain nitrogen-containing resins polyamide, polyimide, and melamine; silicone resins such as methyl silicone resin, and methylphenyl silicone resin; and polyesters obtained by polymerization of bisphenol, glycol, and the like.

Among these compounds, particularly, copolymers of styrenes having good charging property controllability or the like, and α-methylene aliphatic monocarboxylic acids are preferable.

In addition, particularly, from the viewpoint of low hygroscopicity, homopolymers of alicyclic alkyl (meth)acrylate compounds such as cyclohexyl (meth)acrylate or copolymers including the above compounds are preferable.

In the coating resin used in the exemplary embodiment, the content of a constituent unit derived from cyclohexyl (meth)acrylate is preferably 30% by weight or more and more preferably 50% by weight or more with respect to the total weight of the coating resin. The upper limit of the content of the constituent unit derived from cyclohexyl (meth)acrylate is not particularly limited and the upper limit may be 100% by weight or less. The content of the constituent unit derived from cyclohexyl (meth)acrylate of 100% by weight indicates that the coating resin is a homopolymer of cyclohexyl (meth)acrylate.

In addition, for the coating resin, resins other than the above resins may be mixed and used and examples thereof include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, polyacrylate, a vinyl chloride-vinyl acetate copolymer, a styrene-acrylic acid copolymer, a fluororesin, polyester, and polycarbonate. The coating resin is not limited thereto.

The weight average molar weight of the coating resin is preferably from 180,000 to 380,000.

Further, the glass transition temperature (Tg) of the coating resin is not particularly limited and is preferably 50° C. to 150° C., more preferably 70° C. to 120° C., and still more preferably 80° C. to 120° C.

The thermal decomposition starting temperature (TGA) of the coating resin is not particularly limited and is preferably 120° C. to 300° C., more preferably 150° C. to 300° C., and particularly preferably 200° C. to 300° C.

The glass transition temperature of the coating resin is determined by a measurement method with a differential scanning calorimeter (DSC) and may be obtained from the subjective maximum peak measured according to ASTM D3418-8. The measurement of the subjective maximum peak may be carried out using a DSC-7 device manufactured by PerkinElmer Inc. In this device, temperature correction at the detection unit is carried out using the melting temperatures of indium and zinc, and correction of the heat quantity is carried out using the heat of fusion of indium. The sample is placed in an aluminum pan, and using an empty pan as a control, measurement is carried out at a temperature increase rate of 10° C./min. The TGA of the resin is calculated by measuring a reduced amount in a nitrogen atmosphere using a thermal decomposition device (TGA-50, thermal decomposition device for gas chromatography, manufactured by Shimadzu Corporation).

In the exemplary embodiment, the content of the coating resin in the resin coating layer is preferably 50% by weight to 100% by weight, more preferably 60% by weight to 99.8% by weight, and still more preferably 80% by weight to 99.8% by weight with respect to the total weight of the resin coating layer.

Method of Preparing Coating Resin

The coating resin used in the exemplary embodiment is preferably prepared using a persulfate polymerization initiator as a polymerization initiator. Specific examples thereof include ammonium persulfate, sodium persulfate, and potassium persulfate. Since it is desired to control a sodium sulfate structure, ammonium persulfate or sodium persulfate is preferably used. From the viewpoint of controllability of the B/A, ammonium persulfate is more preferable.

In addition, in the case of preparing the coating resin particles by an emulsion polymerization method, it is preferable to use the persulfate polymerization initiator as a polymerization initiator.

The amount of a radical polymerization initiator added, used when the coating resin is prepared in the exemplary embodiment, is not particularly limited. However, it is necessary to control the sulfate ion concentration in the resin coating layer to be 0.05% by weight or less, and thus the amount of the polymerization initiator added is preferably from 0.05% by weight to 2.0% by weight and more preferably from 0.1% by weight to 0.5% by weight with respect to the total amount of monomers for the coating resin.

The molecular weight adjustment of the coating resin in the exemplary embodiment may be carried out using a chain transfer agent. The chain transfer agent is not particularly limited and specifically, those having a covalent bond of carbon atom and sulfur atom are preferable. More specific examples are n-alkylmercaptans such as n-propylmercaptan, n-butylmercaptan, n-amylmercaptan, n-hexylmercaptan, n-heptylmercaptan, n-octylmercaptan, n-nonylmercaptan, and n-decylmercaptan; branched chain type alkylmercaptans such as isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan, and tert-tetradecylmercaptan; aromatic ring-containing mercaptans such as allylymercaptan, 3-phenylpropylmercaptan, phenylmercaptan, mercaptotriphenylmethane.

Surfactant

The resin coating layer used in the exemplary embodiment preferably contains a surfactant.

The surfactant is not particularly limited and the resin coating layer preferably contains at least one selected from the group consisting of anionic surfactants, cationic surfactants, and non-ionic surfactants. Among these, in the exemplary embodiment, anionic surfactants having excellent reactivity with a persulfate polymerization initiator are preferable.

Specific examples of the anionic surfactants include fatty acid soaps such as potassium laurate, sodium oleate, and sodium castor oil; sulfuric esters such as octyl sulfate, lauryl sulfate, lauryl ether sulfate, and nonylphenyl ether sulfate; sodium alkylnaphthalene sulfonates such as lauryl sulfonate, dodecyl sulfonate, dodecylbenzene sulfonate, triisopropylnaphthalene sulfonate, and dibutylnaphthalene sulfonate; sulfonates such as naphthalene sulfonate-formalin condensate, monooctyl sulfosuccinate, dioctyl sulfosuccinate, lauric acid amide sulfonate, and oleic acid amide sulfonate; phosphate esters such as lauryl phosphate, isopropyl phosphate, and nonylphenylether phosphate; sodium dialkylsulfosuccinates such as sodium dioctylsulfosuccinate; and sulfosuccinates such as disodium lauryl sulfosuccinate and disodium lauryl polyoxyethylenesulfosuccinate.

In the exemplary embodiment, the resin coating layer preferably contains sulfo groups and preferably contains alkylbenzene sulfonates as a surfactant. Specific examples thereof include sodium decylbenzene sulfonate, sodium undecylbenzene sulfonate, sodium dodecylbenzene sulfonate, sodium tridecylbenzene sulfonate, and sodium tetradecylbenzene sulfonate. These alkylbenzene sulfonates may be used alone or as a mixture thereof. Commercially available dodecylbenzene sulfonate is a mixture of plural compounds among these compounds mentioned above inmost cases.

Examples of the cationic surfactants include amine salts compounds and quaternary ammonium salt compounds. Specific examples thereof include amine salts such as laurylamine hydrochloride, stearylamine hydrochloride, oleylamine acetate, stearylamine acetate, and stearylaminopropylamine acetate; and quaternary ammonium salts such as lauryl trimethyl ammonium chloride, dilauryl dimethyl ammonium chloride, distearyl ammonium chloride, distearyl dimethyl ammonium chloride, lauryl dihydroxy ethyl methyl ammonium chloride, oleyl bispolyoxyethylenemethyl ammonium chloride, lauroyl aminopropyl dimethyl ethyl ammonium ethosulfate, lauroyl aminopropyl dimethyl hydroxy ethyl ammonium perchlorate, alkylbenzene dimethyl ammonium chloride, and alkyl trimethyl ammonium chloride.

Specific examples of the non-ionic surfactants include alkyl ethers such as polyoxyethylene octyl ether, polyoxyethylene lauryl ether, polyoxyethylene stearyl ether, and polyoxyethylene oleyl ether; alkylphenyl ethers such as polyoxyethylene octylphenyl ether, and polyoxyethylene nonylphenyl ether; alkyl esters such as polyoxyethylene laurate, polyoxyethylene stearate, and polyoxyethylene oreate; alkylamines such as polyoxyethylene lauryl amino ether, polyoxyethylene stearyl amino ether, polyoxyethylene oleyl amino ether, polyoxyethylene soybean amino ether, and polyoxyethytlene tallow amino ether; alkylamides such as polyoxyethylene lauric amide, polyoxyethylene stearic amide, and polyoxyethylene oleic amide; vegetable oil ethers such as polyoxyethylene castor oil ether and polyoxyethylene rape oil ether; alkanole amides such as lauric diethanol amide, stearic diethanol amide, and oleic diethanol amide, and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

In the exemplary embodiment, the content of the surfactant is preferably from 0.05% by weight to 2.0% by weight and more preferably from 0.1% by weight to 0.5% by weight with respect to the total weight of the coating resin. When the content of the surfactant is 0.05% by weight or more, coating resin particles having a desired particle diameter are obtained and when the content of the surfactant is 2.0% by weight or less, a rapid charge reduction caused by hygroscopicity is prevented.

The content of the surfactant with respect to the total weight of the coating resin of the carrier in the exemplary embodiment is measured by putting 5 g of the carrier and 50 g of chloroform into a beaker, sufficiently dissolving the coating resin with an ultrasonic disperser, separating insoluble portions such as magnetic particles and a conductive material by filtration to obtain a coating resin extract, and extracting the surfactant from the coating resin extract to obtain the content of the surfactant by a high-speed liquid chromatography method or the like.

Charge-Controlling Agent

Examples of a charge-controlling agent that may be included in the resin coating layer in the carrier according to the exemplary embodiment include any known charge-controlling agent such as nigrosine dyes, benzimidazole compounds, quaternary ammonium salt compounds, alkoxylated amines, alkylamides, molybdic acid chelate pigments, triphenylmethane compounds, salicylic acid metal complexes, azo chromium complexes, and copper phthalocyanine. Quaternary ammonium salt compounds, alkoxylated amines, and alkylamides are particularly preferable.

The amount of the charge-controlling agent added, which is used in the exemplary embodiment, is preferably from 0.001 parts by weight to 5 parts by weight and more preferably from 0.01 parts by weight to 0.5 parts by weight with respect to 100 parts by weight of the magnetic particles.

Conductive Material

Examples of a conductive material that may be added to the resin coating layer in the exemplary embodiment include carbon black, metals such as gold, silver, and copper, titanium oxide, zinc oxide, tin oxide, barium sulfate, aluminum borate, potassium titanate, tin oxide, tin oxide doped with antimony, indium oxide doped with tin, zinc oxide doped with aluminum, and metal-coating resin particles.

The content of the conductive material is preferably from 0.01 parts by weight to 10 parts by weight and more preferably from 0.05 parts by weight to 5 parts by weight with respect to 100 parts by weight of the coating resin in terms of obtaining the volume intrinsic resistance of the carrier as desired characteristics.

When the content of the conductive material is 0.01 parts by weight or more, the resistance adjustment effect is obtained and thus this case is preferable. When the content thereof is 10 parts by weight or less, the conductive material is less likely to be separated and thus this case is preferable.

Thermosetting Resin Particles and Crosslinked Resin Particles

The resin coating layer in the exemplary embodiment may contain thermosetting resin particles and crosslinked resin particles in order to enhance the strength.

The thermosetting resin particles and the crosslinked resin particles are prepared by synthesizing resin particles by an emulsion polymerization method, a suspension polymerization method, and the like, or pulverizing and classifying resin after synthesis and emulsifying and dispersing resin in water. In the exemplary embodiment, resin particles prepared through polymerization by an emulsion polymerization method using a polymerization initiator and a surfactant and drying are preferably used.

The thermosetting resin particles are not particularly limited and as long as the resin particles are formed of a thermosetting resin. However, resin particles formed of a nitrogen element-containing resin are preferable. Among these, melamine resin, urea resin, urethane resin, guanamine resin, and amide resin exhibit high positive charging properties and high resin hardness, and the high resin hardness prevents a reduction in charge amount caused by peeling of the resin coating layer or the like. Thus, these resins are preferable.

Commercially available thermosetting resin particles may be used and examples thereof include EPOSTAR S (melamine-formaldehyde condensation resin, manufactured by NIPPON SHOKUBAI CO., LTD.), and EPOSTAR MS (benzoguanamine-formaldehyde condensation resin, manufactured by NIPPON SHOKUBAI CO., LTD.).

The crosslinked resin particles are not particularly limited as long as the resin particle is a polymer of a polymerizable monomer. For example, a rein using at least one selected from styrene compounds, (meth)acrylate compounds, and polyvinyl compounds having good charging property controllability is preferable.

Examples of the styrene compounds include styrene and α-methylstyrene.

Examples of the (meth)acrylate compounds include (meth)acrylate and alkyl (meth)acrylate compounds. Examples of the alkyl (meth)acrylate compounds include methyl (meth)acrylate, ethyl (meth)acrylate, and aliphatic alkyl (meth)acrylate compounds such as cyclohexyl (meth) acrylate.

Among these, homopolymers or copolymers of aliphatic (meth)acrylate compounds having low hygroscopicity are preferable. Examples of the aliphatic (meth)acrylate compounds include cyclohexyl methacrylate.

The crosslinked resin particles may contain a nitrogen-containing monomer to obtain a charge imparting effect. Examples thereof include dialkylaminoalkyl (meth)acrylates such as diethylaminoethyl (meth)acrylate and dimethylaminoethyl (meth)acrylate, alkylaminoalkyl (meth)acrylates such as ethylaminoethyl (meth)acrylate and methylaminoethyl (meth)acrylate, aminoalkyl (meth)acrylates such as aminoethyl (meth)acrylate, 1,2,2,6,6-pentamethyl-4-piperidyl methacrylate, and 2,2,6,6-tetramethyl-4-piperidyl methacrylate.

When the crosslinked resin particles are prepared, the method of forming a cross-linked structure is not particularly limited and a method of using a crosslinking agent of a cross-linkable monomer or the like may be used.

Specific examples of the crosslinking agent include aromatic polyvinyl compounds such as such as divinylbenzene and divinylnaphthalene; polyvinyl esters of aromatic polyvalent carboxylic acids such as divinyl phthalate, divinyl isophthalate, divinyl terephthalate, divinyl homophthalate, divinyl/trivinyl trimesate, divinyl naphthalene dicarboxylate, and divinyl biphenylcarboxylate; divinyl esters of nitrogen-containing aromatic compounds, such as divinyl pyridine dicarboxylate; vinyl esters of unsaturated heterocyclic compound carboxylic acids such as vinyl pyromucate, vinyl furan carboxylate, vinyl pyrrole-2-carboxylate, and vinyl thiophene carboxylate; (meth)acrylic esters of linear polyols such as butanediol methacrylate, hexanediol acrylate, octanediol methacrylate, decanediol acrylate, and dodecanediol methacrylate; (meth)acrylic esters of branched and substituted polyols such as neopentyl glycol dimethacrylate and 2-hydroxy-1,3-diacryloxy propane; polyethylene glycol di(meth)acrylate, polypropylene polyethylene glycol di(meth)acrylates; and polyvinyl esters of polyvalent carboxylic acids such as divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, dodecane diacid divinyl, and divinyl brassylate.

In the exemplary embodiment, these crosslinking agents may be used alone or in combination of two or more kinds thereof. In addition, among these crosslinking agents, acrylate crosslinking agents are preferable from the viewpoint of not deteriorating the charging properties of the coating resin, and (meth)acrylic esters of linear polyols such as butanediol methacrylate, hexnediol acrylate, octanediol methacrylate, decanediol acrylate, and dodecanediol methacrylate; (meth) acrylic esters of branched and substituted polyols such as neopentyl glycol dimethacrylate and 2-hydroxy-1,3-diacryloxy propane; polyethylene glycol di(meth)acrylate, polypropylene polyethylene glycol di(meth)acrylates, and the like are preferably used.

In the exemplary embodiment, the crosslinked resin particles may be prepared in the same manner as in the preparation of the coating resin particles and a preferable embodiment of the preparation method is also the same.

In the exemplary embodiment, the volume average particle diameters of the thermosetting resin particles and the crosslinked resin particles are typically 3 μm or less and is preferably in a range of from 10 nm to 1,000 nm. When the volume average particle diameters of the respective particles are 3 μm or less, exposure from the resin coating layer is prevented, other additives are satisfactorily dispersed, and thus performance and reliability are improved. In addition, the strength of the resin coating layer of the carrier is suitably maintained and abrasion during long-term use is controlled. The particle diameters of the respective thermosetting resin particles and the crosslinked resin particles may be the same or may be adjusted in consideration of dispersibility and the strength of the coating resin. The volume average particle diameters of the both particles may be measured by using, for example, a microtrack or the like.

As the method of analyzing the particle composition in the coating resin of the carrier in the exemplary embodiment, there is a method of putting 5 g of the carrier and 100 g of toluene into a beaker, then sufficiently dissolving the coating resin with an ultrasonic disperser and removing magnetic particles with a magnet, dissolving 20 mg of the coating resin obtained by, after filtering, cleaning, and separating insoluble portions, diluting the insoluble portions again, and separating a conductive material and an additive in 10 mL of chloroform and filtering the solution, and then analyzing the composition by an infrared absorption spectrum analyzing method or the like.

Characteristics of Resin Coating Layer

The average film thickness of the resin coating layer is, for example, from 0.1 μm to 10 μm. However, in order to exhibit stable volume intrinsic resistance of the carrier for a long period of time, the average film thickness is preferably from 0.5 μm to 3 μm. The average film thickness (μm) of the resin coating layer may be measured by cutting the carrier particles with a microtome or the like, and observing and analyzing the section with a scanning type electron microscope.

As the coverage becomes closer to 100%, the coverage of the magnetic particle surface with the resin coating layer is more preferable, and the coverage is more preferably 80% or more and still more preferably 85% or more.

The coverage of the resin coating layer may be obtained by XPS measurement. For example, using JPS 80, manufactured by JEOL Ltd., as XPS measurement device, measurement is carried out by using a MgKα ray as the X-ray source. The acceleration voltage is set to 10 kV and the emission current is set to 20 mV. About the element which mainly constitutes the resin coating layer (typically, carbon), and the element which mainly constitutes the core (for example, iron and oxygen in the case in which the core is formed of an iron oxide based material such as magnetite), the amounts thereof are measured (hereinafter, the case in which the core is formed of iron oxide based material will be described). About carbon, iron and oxygen, the C1s spectrum thereof, the $Fe2p_{3/2}$ spectrum, and the O1s spectrum are measured, respectively.

Based on the respective spectra of these elements, the number of the elements of carbon, oxygen and iron ($A_C+A_O+A_{Fe}$) is obtained. The obtained element number ratio among carbon, oxygen and iron is used to obtain the iron amount ratio in the core alone and the iron amount ratio in the core after the magnetic particles are coated with the resin coating layer (carrier) based on the following equation (B), and then the coverage is obtained by the following equation (C).

$$\text{Iron amount ratio(atomic \%)}=A_{Fe}/(A_C+A_O+A_{Fe})\times 100 \quad \text{Equation (B)}$$

$$\text{Coverage (\%)}=\{1-(\text{the iron amount ratio in the carrier})/(\text{the iron amount ratio in the core alone})\}\times 100 \quad \text{Equation (C)}$$

In the case of using a material other than the iron oxide material for the magnetic particles, the spectrum of the metal element which constitutes the core is measured besides that of oxygen, and then substantially the similar calculation may be made according to the above equations (B) and (C) to obtain the coverage.

Characteristics of Carrier

The weight reduction amount of the electrostatic charge image developing carrier of the exemplary embodiment in the thermal weight measurement of the carrier at a temperature in a range of from 120° C. to 180° C. is preferably 0.01% by weight or less. The weight reduction amount is more preferably 0.005% by weight or less and still more preferably 0.003% by weight or less. The lower limit of the weight reduction amount is not particularly limited and may be 0 or more.

For the weight reduction amount, the diameter of the toner particles in the electrostatic charge developer are reduced to be smaller than the diameter of the carrier particles and the toner is separated using a sieving met having openings larger than the diameter of the toner particles or the like. Nitrogen is allowed to flow at a flow rate of 30 ml/min and the toner is held at 30° C. for 30 minutes. Then, the toner is heated to 300 degrees at a heating rate of 20° C./min, and a weight reduction amount at a temperature in a range of from 120° C. to 180° C. may be measured using a differential thermal/thermogravimetry simultaneous measurement device DTG-60AH.

When the method of preparing the carrier includes a heating process, which will be described later, the weight reduction amount may be reduced.

The volume intrinsic resistance of the carrier according to the exemplary embodiment is preferably from $10^6$ Ω·cm to $10^{14}$ Ω·cm, which respectively correspond to the upper and lower limits of the typical development contrast potential at 1,000 V, and more preferably from $10^8$ Ω·cm to $10^{13}$ Ω·cm to achieve high image quality. The volume intrinsic resistance of the carrier may be obtained using a typical inter-electrode electrical resistance measurement method in which the carrier particles are sandwiched between two polar plate electrodes, and the current at the time when a voltage is applied is measured.

When the volume intrinsic resistance of the carrier is $10^6$ Ω·cm or more, the reproducibility of fine lines is improved, the amount of carrier to be to transferred to a photoreceptor (image holding member) is reduced and thus damage to the photoreceptor is prevented. On the other hand, when the volume intrinsic resistance of the carrier is $10^{14}$ Ω·cm or less, the reproducibility of a black solid image and a halftone image is improved.

The volume average particle diameter of the carrier according to the exemplary embodiment is preferably from 20 μm to 100 μm.

When the volume average particle diameter of the carrier is 20 μm or more, the carrier is prevented from being developed with the toner and when the volume average particle diameter of the carrier is 100 μm or less, the toner is likely to be evenly charged.

The volume average particle diameter of the carrier is measured using a laser diffraction/scattering particle diameter distribution meter (LS Particle Size Analyzer: LS13 320, manufactured by Beckman Coulter Inc.).

In addition, the shape factor SF1 of the carrier is preferably from 100 to 145. When the shape factor is within the above range, the hardness of a magnetic brush may be appropriately maintained and the stirring effect of the developer is less likely to be deteriorated. Thus, charging control is easy.

The shape factor SF1 of the carrier is a value obtained by the following equation (D).

$$SF1=100\pi\times(ML)^2/(4\times A) \quad \text{Equation (D)}$$

Herein, ML represents the maximum length of the carrier particle, and A represents the projected area of the carrier particle.

The maximum length and projected area of the carrier particle are obtained by observing a sampled carrier particle on a slide glass with an optical microscope, taking the resultant image into an image analyzer (LUZEX III, manufactured by NIRECO Corp.) via a video camera, and carrying out image analysis. The number of the sampled particles at this time is 100 or more. The average value of the shape factors of the 100 or more particles is used as the shape factor indicated by the equation (D).

The saturation magnetization of the carrier is preferably from 40 emu/g to 100 emu/g and more preferably from 50 emu/g to 100 emu/g.

For the measurement of magnetic properties, vibrating sample magnetometer, VSMP10-15 (manufactured by Toei Industry Co., Ltd.) is used. A measurement sample is packed in a cell having an inner diameter of 7 mm and a height of 5 mm and the cell is set in the magnetometer. The measurement is carried out as follows: a magnetic field is applied and swept up to 1,000 Oe. Next, the applied magnetic field is decreased and a hysteresis curve is drawn on a recording sheet. The saturation magnetization, residual magnetization, and coercive force are obtained from the hysteresis curve data. In the exemplary embodiment, the saturation magnetization refers to a magnetization that is measured at a magnetic field of 1,000 Oe.

Method of Preparing Electrostatic Charge Image Developing Carrier

The carrier of the exemplary embodiment may be prepared by applying and forming a resin coating layer on the magnetic particle surface.

As the method of the application and formation, there are a wet method using a solvent and a dry method not using a solvent.

The method of preparing the electrostatic charge image developing carrier of the exemplary embodiment is preferably a dry method and more preferably includes a mixing process of mixing magnetic particles and a coating resin to obtain a mixture in which the coating resin particles adhere to the surface of the magnetic particles, and a heating process of heating the mixture at 150° C. or higher.

Hereinafter, the details of the method of preparing the electrostatic charge image developing carrier in the exemplary embodiment will be described.

Wet Method

As the wet method, a dipping method of putting a coating resin, and an additive such as a conductive material or the like in a solvent soluble for the coating resin to prepare a resin coating layer forming solution, and dipping magnetic particles in a resin coating layer forming solution, a spraying method of spraying a resin coating layer forming solution onto the surface of magnetic particles, a fluid bed method of spraying a resin coating layer forming solution in a state in which magnetic particles are caused to float by using flowing air or the like, and a kneader coater method of mixing magnetic particles and a resin coating layer forming solution in a kneader coater and then removing the solvent may be used.

Dry Method

Mixing Process

As the dry method, a method of preparing a carrier including a mixing process of mixing the magnetic particles and the coating resin particles to obtain a mixture in which the coating resin particles adhere to the surface of the magnetic particles may be used.

In the mixing process, the coating resin particles preferably adhere to the surface of the core magnetic particles with a mechanical impact force.

As a device for mixing the magnetic particles and the coating resin particles, a known powder mixing device may be used and the device may be a batch type mixing device or a continuous mixing device. Preferable examples of the batch type mixing device include mixing devices with a stirrer such as a HENSCHEL MIXER or NAUTA MIXER. In addition, examples of the continuous mixing device include a uniaxial or biaxial paddle mixer, ribbon mixer, or extrusion mixer. However, there is no limitation thereto.

The mixing temperature during the mixing is preferably equal to or lower than the glass transition temperature of the coating resin included in the coating resin particles, more preferably a temperature 10° C. or more lower than the glass transition temperature of the coating resin included in coating resin particles, and still more preferably a temperature 20° C. or more lower than the glass transition temperature of the coating resin included in coating resin particles.

In the exemplary embodiment, the method of incorporating the surfactant into the resin coating layer is not particularly limited and a method of using coating resin particles obtained by synthesizing coating resin particles using the surfactant by an emulsion polymerization method, and drying the synthesized coating resin particles by a freeze-drying method or the like, in the mixing process may be used. According to the above method, the amount of the surfactant included in the final resin coating layer is easily adjusted by adjusting the amount of the surfactant used during the incorporation.

In addition, a method of preparing the coating resin particles containing plural surfactants by further adding other surfactants to the coating resin particles obtained using a surfactant by an emulsion polymerization method after polymerization is completed, and drying resin particles may be used.

In addition, in the exemplary embodiment, the method of incorporating the charge-controlling agent into the resin coating layer is not particularly limited and the charge-controlling agent may be added after mixing with the coating resin particles in advance or may be added individually. However, the charge-controlling agent is preferably mixed with the resin particles in advance in order to obtain a uniform structure. In addition, the composition ratio may be changed to control the structure of the resin coating layer and the charge-controlling agent may be added to the resin coating layer in plural times.

The method of incorporating the conductive material into the resin coating layer in the exemplary embodiment is not particularly limited and the conductive material may be added after mixing with the coating resin particles in advance or may be added individually. However, the conductive material is preferably mixed with the resin particles in advance in order to obtain a uniform structure. In addition, the composition ratio may be changed to control the structure of the resin coating layer and the conductive material may be added to the resin coating layer in plural times.

Further, in the exemplary embodiment, the method of incorporating the thermosetting resin particles and the crosslinked resin particles into the resin coating layer is not particularly limited and a method of further adding the thermosetting resin particles and the crosslinked resin particles to the resin coating layer when the magnetic particles and the coating resin particles are mixed may be used.

Heating Process

It is preferable that the method of preparing the carrier in the exemplary embodiment further include a heating process of heating the mixture to 150° C. or higher.

Through the heating process, the amount of the polymerization initiator remaining in the resin coating layer may be adjusted by decomposing the polymerization initiator remaining in the resin coating layer, particularly, the remaining persulfate polymerization initiator, and further discharging sulfides other than sulfate in the form of sulfur dioxide or the like.

The heating temperature is preferably from 150° C. to 250° C. and more preferably from 160° C. to 230° C. When the heating temperature is within the above range, the resin may be easily melted and the thermal decomposition of the resin is prevented. Thus, this case is preferable.

In the heating process, from the viewpoint of preventing adhesion between the particles from being broken to form coarse aggregates, it is preferable to heat the magnetic particles coated with the coating resin particles while stirring and mixing. From the productivity, it is more preferable to conduct heating while continuous stirring and mixing. As a device used for the heating treatment process, a paddle mixer, screw mixer, TURBULIZER, continuous kneader, or biaxial extrusion kneader, provided with a heating unit, or the like may be used and the device is not limited thereto.

The method of preparing the electrostatic charge image developing carrier in the exemplary embodiment may include known processes other than the mixing process and the heating process. Specifically, the method may include a classification process of classifying the magnetic particles having the obtained resin coating layer, a sieving process of sieving the magnetic particles having the obtained resin coating layer with a sieve, and the like. The classification unit and the sieve used in the classification process and the sieving process are not particularly limited and known classification units and sieves may be used.

Electrostatic Charge Image Developer

The electrostatic charge image developer according to the exemplary embodiment is constituted as a two-component developer containing the carrier according to the exemplary embodiment and an electrostatic charge image developing toner (hereinafter, also simply referred to as "toner").

In the two-component developer, the mixing ratio (weight ratio) between the toner and the carrier is preferably toner: carrier=1:100 to 30:100 and more preferably 3:100 to 20:100.

Hereinafter, the toner used for the electrostatic charge image developer according to the exemplary embodiment will be described.

Electrostatic Charge Image Developing Toner

The toner used in the exemplary embodiment includes toner base particles and if necessary, an external additive.

Toner Base Particles

The toner base particles include, for example, a binder resin, and if necessary, a colorant, a release agent, and other additives.

Binder Resin

Examples of the binder resin include a homopolymer of monomers such as styrenes (for example, styrene, parachlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenically unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), and a vinyl resins formed of copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and a modified rosin, a mixture of these and the vinyl resins, and a graft polymers obtained by polymerizing a vinyl monomer in the co-presence of these.

These binder resins may be used alone or in combination with two or more kinds thereof.

As the binder resin, a polyester resin is preferable.

Examples of the polyester resin include known polyester resins.

Examples of the polyester resin include condensation polymers of polyvalent carboxylic acids and polyols. As the polyester resin, commercially available products may be used and synthetic products may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, bisphenol A ethylene oxide adduct and bisphenol A propylene oxide adduct). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K-1987 "Testing Methods for Transition Temperature of Plastics". The weight average molecular weight (Mw) of the polyester resin is preferably from 5,000 to 1,000,000 and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100 and more preferably from 2 to 60.

The weight molecular weight and the number average molecular weight are measured by gel permeation chromatography (GPC). The molecular weight measurement by GPC is carried out by using GPC•HLC-8120GPC manufactured by Tosoh Corporation as a measuring device, TSKgel SuperHM-M (15 cm) manufactured by Tosoh Corporation, as a column, and a THF solvent. The weight molecular weight and the number average molecular weight are calculated using a calibration curve of molecular weight created with a monodisperse polystyrene standard sample from the measurement results.

A known preparation method is applied to obtain the polyester resin. Specific examples thereof include a method of conducting a reaction at a polymerization temperature set to from 180° C. to 230° C., if necessary, under reduced pressure in the reaction system, while removing water or an alcohol produced during condensation.

In the case in which monomers of the raw materials are not dissolved or compatibilized under a reaction temperature, a high-boiling-point solvent may be added as a solubilizing agent to dissolve the monomers. In this case, a polycondensation reaction is carried out while distilling away the solubilizing agent. In the case in which a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably from 40% by weight to 95% by weight, more preferably from 50% by weight to 90% by weight, and still more preferably from 60% by weight to 85% by weight with respect to the entire toner base particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DUPONT oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination of two or more kinds thereof.

If necessary, the colorant may be surface-treated or used in combination with a dispersing agent. Plural kinds of colorants may be used in combination.

The content of the colorant is, for example, preferably from 1% by weight to 30% by weight and more preferably from 3% by weight to 15% by weight with respect to the entire toner base particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C. and more preferably from 60° C. to 100° C.

The melting temperature is obtained from "melting peak temperature" described in the method of obtaining a melting temperature in JIS K-1987 "testing methods for transition temperatures of plastics", from a DSC curve obtained by differential scanning calorimetry (DSC).

The content of the release agent is, for example, preferably from 1% by weight to 20% by weight and more preferably from 5% by weight to 15% by weight with respect to the entire toner base particles.

Other Additives

Examples of other additives include known additives such as a magnetic material, a charge-controlling agent, and an inorganic powder. The toner base particles contain these additives as internal additives.

Characteristics of Toner Base Particles or the Like

The toner particles may be toner particles having a single-layer structure, or toner base particles having a so-called core/shell structure composed of a core (core particle) and a resin coating layer (shell layer) coated on the core.

Here, toner base particles having a core/shell structure is preferably composed of, for example, a core containing a binder resin, and if necessary, other additives such as a colorant and a release agent, and a resin coating layer containing a binder resin.

The volume average particle diameter ($D_{50v}$) of the toner base particles is preferably from 2 μm to 10 μm and more preferably from 4 μm to 8 μm.

Various average particle diameters and various particle diameter distribution indices of the toner base particles are measured using a COULTERMULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of a surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle diameter ranges (channels) divided based on the measured particle diameter distribution. The particle diameter when the cumulative percentage becomes 16% is defined as that corresponding to a volume average particle diameter $D_{16v}$ and a number average particle diameter $D_{16p}$, while the particle diameter when the cumulative percentage becomes 50% is defined as that corresponding to a volume average particle diameter $D_{50v}$ and a number average particle diameter $D_{50p}$. Furthermore, the particle diameter when the cumulative percentage becomes 84% is defined as that corresponding to a volume average particle diameter $D_{84v}$ and a number average particle diameter $D_{84p}$.

Using these, a volume average particle diameter distribution index ($GSD_v$) is calculated as $(D_{84v}/D_{16v})^{1/2}$, while a number average particle diameter distribution index ($GSD_p$) is calculated as $(D_{84p}/D_{16p})^{1/2}$.

The average circularity of the toner particles is preferably from 0.88 to 0.98 and more preferably from 0.92 to 0.97.

The average circularity of the toner is preferably measured by FPIA-3000 manufactured by Sysmex Corporation. This device employs a system of measuring particles dispersed in water or the like by a flow type image analysis method, and a sucked particle suspension is put into a flat sheath flow cell and formed into a flat sample flow by a sheath liquid. By irradiating the sample flow with strobe light, the particles under passing are imaged as a static image by a CCD camera through an objective lens. The imaged particle image is subjected to two-dimensional image processing, and the circularity is calculated from the projected area and peripheral length. With respect to the circularity, each of at least 4,000 of the imaged particles are each subjected to mage analysis and statistically processed to determine the average circularity.

$$\text{Circularity}=\text{Peripheral length of equivalent circle diameter/Peripheral length}=[2\times(A\pi)^{1/2}]/PM$$

In the equation, A represents a projected area and PM represents a peripheral length of a particle.

Incidentally, in the measurement, an HPF mode (high resolution mode) is used, and the dilution ratio is set up at 1.0 time. Also, in analyzing the data, for the purpose of removing measurement noises, the analysis range of number particle diameter is set within the range of from 2.0 μm to 30.1 μm, and the analysis range of circularity is chosen within the range of from 0.40 to 1.00.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$.

In the exemplary embodiment, from the viewpoint of obtaining stable printing quality for a long period of time, as the external additive, an external additive having a volume average particle diameter of from 50 nm to 200 nm is particularly preferably used. However, the external additive having a particle diameter in the above range tends to be embedded into the carrier surface, deformed, polished and the like.

However, in the exemplary embodiment, in the case of using the toner having the external additive having a particle diameter in the above range, the abrasion of the resin coating layer of the carrier is appropriately controlled and as a result, image defects such as white spots may be prevented.

The surface of the inorganic particles as the external additive is preferably treated with a hydrophobizing agent. The hydrophobizing treatment may be carried out by, for example, dipping the inorganic particles in a hydrophobizing agent. The hydrophobizing agent is not particularly limited and examples thereof include a silane coupling agent, a silicone oil, a titanate coupling agent, and an aluminum coupling agent. These agents may be used alone or in combination of two or more kinds thereof.

For example, the amount of the hydrophobizing agent is typically from 1 part by weight to 10 parts by weight with respect to 100 parts by weight of the inorganic particles.

Examples of the external additive include resin particles (resin particles of polystyrene, polymethyl methacrylate (PMMA), melamine resin, and the like), and a cleaning aid (for example, particles of a higher fatty acid metal salt represented as zinc stearate and a fluorine polymer).

The amount of the external additive externally added is, for example, preferably from 0.01% by weight to 5% by weight and more preferably from 0.01% by weight to 2.0% by weight with respect to the toner base particles.

Preparing Method of Toner

Next, the method of preparing the toner according to the exemplary embodiment will be described.

The toner according to the exemplary embodiment may be obtained by preparing toner base particles and then adding an external additive to the toner base particles.

The toner base particles may be prepared by any of a dry method (for example, a kneading and pulverizing method or the like), and a wet method (for example, an aggregation and coalescence method, a suspension polymerization method, a dissolution suspension method, or the like). The preparation of the toner base particles is not particularly limited to these methods and a known method may be employed.

Among these, the toner base particles are preferably obtained by the aggregation and coalescence method.

Specifically, for example, in the case of preparing the toner base particles by the aggregation and coalescence method, the toner base particles are prepared through a process of preparing a resin particle dispersion in which resin particles which become a binder resin are dispersed (resin particle dispersion preparation process), a process of forming aggregated particles by aggregating the resin particles (if necessary, other particles) in the resin particle dispersion (if necessary, in the dispersion after other particle dispersions are mixed), (aggregated particle forming process), and a process of forming toner base particles by heating an aggregated particle dispersion in which the aggregated particles are dispersed to coalesce the aggregated particles (coalescing process).

Hereinafter, each process will be described in detail.

While a method of obtaining toner base particles containing a colorant and a release agent will be described in the following description, the colorant and the release agent are used if necessary. Any additive other than colorants and release agents may, of course, be used.

Resin Particle Dispersion Preparation Process

First, along with a resin particle dispersion in which resin particles which becomes a binder resin are dispersed, for example, a colorant particle dispersion in which colorant particles are dispersed, and a release agent particle dispersion in which release agent particles are dispersed are prepared.

Herein, the resin particle dispersion is prepared, for example, by dispersing the resin particles in a dispersion medium by aid of a surfactant.

An example of the dispersion medium used in the resin particle dispersion includes an aqueous medium.

Examples of the aqueous medium include water such as distilled water and ion exchange water, and alcohols and the like. These may be used alone or in combination of two or more kinds thereof.

Examples of the surfactant include anionic surfactants such as sulfuric ester salts, sulfonates, phosphoric esters and soap surfactants; cationic surfactants such as amine salts and quaternary ammonium salts; and nonionic surfactants such as polyethylene glycol, alkylphenol ethylene oxide adducts and polyols. Among these, particularly, anionic surfactants and cationic surfactants are preferable. The nonionic surfactants may be used in combination with anionic surfactants or cationic surfactants.

The surfactants may be used alone or in combination of two or more kinds thereof.

In the resin particle dispersion, the resin particles may be dispersed in the dispersion medium by a general dispersion method, for example, by using a rotary shear type homogenizer, or a ball mill, a sand mill, or a dynomill having media. Further, depending on the kind of resin particles, the resin particles may be dispersed in the resin particle dispersion, for example, by a phase inversion emulsification method.

The phase inversion emulsification method is a method in which a resin to be dispersed is dissolved in a hydrophobic organic solvent capable of dissolving the resin, abase is added to the organic continuous phase (O phase) to neutralize the resin, an aqueous medium (W phase) is added to invert the resin into a discontinuous phase from W/O to O/W (so-called phase inversion), so that the resin may be dispersed in the form of particles in the aqueous medium.

The volume average particle diameter of the resin particles dispersed in the resin particle dispersion is preferably, for example, from 0.01 μm to 1 μm, more preferably from 0.08 μm to 0.8 μm, and still more preferably from 0.1 μm to 0.6 μm.

The volume average particle diameter of the resin particles is measured such that using the particle diameter distribution measured by a laser diffraction particle diameter distribution measuring device (LA-700, manufactured by Horiba Seisakusho Co., Ltd.), a cumulative distribution is drawn from the small diameter side with respect to the volume based on the divided particle diameter ranges (channels) and the particle diameter at which the cumulative volume distribution reaches 50% of the total particle volume is defined as a volume average particle diameter $D_{50v}$. Hereinafter, the volume average particle diameter of particles in the other dispersion will be measured in the same manner.

For example, the content of the resin particles contained in the resin particle dispersion is preferably from 5% by weight to 50% by weight and more preferably from 10% by weight to 40% by weight.

For example, the colorant particle dispersion and the release agent particle dispersion may be prepared in a manner similar to the dispersion of resin particles. That is, with respect to the volume average particle diameter of the particles, the dispersion medium, the dispersion method and the content of the particles in the resin particle dispersion, the same is applied to the colorant particles dispersed in the colorant particle dispersion and the release agent particles dispersed in the release agent particle dispersion.

Aggregated Particle Forming Process

Next, along with the resin particle dispersion, the colorant particle dispersion and the release agent particle dispersion are mixed.

Then, in the mixed dispersion, the resin particles, the colorant particles and the release agent particles are hetero-aggregated to form aggregated particles containing the resin particles, the colorant particles and the release agent particles, which have an approximately targeted particle diameter of the toner base particle.

Specifically, for example, an aggregation agent is added to the mixed dispersion, and the pH of the mixed dispersion is adjusted to an acidic range (for example, from pH 2 to 5). If necessary, a dispersion stabilizer is added thereto, followed by heating to the glass transition temperature of the resin particles (specifically, for example, from the glass transition temperature of the resin particles −30° C. to the glass transition temperature −10° C.). The particles dispersed in the mixed dispersion are aggregated to form aggregated particles.

In the aggregated particle forming process, for example, the aggregation agent is added to the mixed dispersion while stirring using a rotary shear type homogenizer at room temperature (for example, 25° C.), and the pH of the mixed dispersion is adjusted to an acidic range (for example, from pH 2 to 5). If necessary, a dispersion stabilizer may be added thereto, followed by heating.

Examples of the aggregation agent include a surfactant having a polarity opposite to the polarity of the surfactant used as the dispersant which is added to the mixed dispersion, for example, an inorganic metal salt and a divalent or higher-valent metal complex. Particularly, in the case in which a metal complex is used as an aggregation agent, the amount of the surfactant used is reduced, which results in improvement of charging properties.

An additive capable of forming a complex or a similar bond with a metal ion in the aggregation agent may be used if necessary. As the additive, a chelating agent is suitably used.

Examples of the inorganic metal salt include metal salts such as calcium chloride, calcium nitrate, barium chloride, magnesium chloride, zinc chloride, aluminum chloride and aluminum sulfate, and polymers of inorganic metal salts such as polyaluminum chloride, polyaluminum hydroxide and calcium polysulfide.

The chelating agent may be a water soluble chelating agent. Examples of the chelating agent include oxycarboxylic acids such as tartaric acid, citric acid and gluconic acid, iminodiacetic acid (IDA), nitrilotriacetic acid (NTA), and ethylenediaminetetraacetic acid (EDTA).

The amount of the chelating agent added is preferably from 0.01 parts by weight to 5.0 parts by weight and more preferably 0.1 parts by weight or more and less than 3.0 parts by weight with respect to 100 parts by weight of the resin particles.

Coalescing Process

Next, the aggregated particles are coalesced by heating the aggregated particle dispersion having the aggregated particles dispersed therein to, for example, the glass transition temperature of the resin particles (for example, 10° C. to 30° C. higher than the glass transition temperature of the resin particles) or higher, to form toner base particles.

The toner base particles are obtained by the above-described processes.

Further, the toner base particles may be prepared by a process of forming second aggregated particles by obtaining an aggregated particle dispersion having the aggregated particles dispersed therein, mixing the aggregated particle dispersion and the resin particle dispersion having the resin particles dispersed therein and further carrying out aggregation so as to attach the resin particles on the surface of the aggregated particles, and a process of coalescing the second aggregated particles by heating a second aggregated particle dispersion having the second aggregated particles dispersed therein to form toner base particles having a core and shell structure.

After the coalescing process is completed, the toner base particles formed in the solution are subjected to known washing, solid-liquid separation and drying processes to obtain dried toner base particles.

The washing process is preferably carried out by a sufficient replacement washing with ion exchange water from the viewpoint of charging properties. The solid-liquid separation process is not particularly limited but is preferably carried out by filtration under suction or pressure from the viewpoint of productivity. The drying process is not particularly limited but is preferably carried out by freeze-drying, flash jet drying, fluidized drying or vibration fluidized drying from the viewpoint of productivity.

The toner according to the exemplary embodiment is prepared by, for example, adding an external additive to the obtained dried toner base particles, and mixing the materials. The mixing is preferably carried out using, for example, a V blender, a HENSCHEL MIXER, a LODIGE mixer and the like. Further, if necessary, coarse particles of the toner are preferably removed using a vibration sieve or a wind classifier.

Image Forming Apparatus and Image Forming Method

An image forming apparatus and an image forming method according to the exemplary embodiment will be described.

The image forming apparatus according to the exemplary embodiment includes an image holding member; a charging unit that charges the image holding member; an exposing unit that exposes the charged image holding member to light to form an electrostatic latent image on the image holding member; a developing unit that develops the electrostatic latent image with an electrostatic charge image developer to form a toner image; a transfer unit that transfers the toner image from the image holding member to a transfer medium; and a fixing unit that fixes the toner image. As the electrostatic charge image developer, the electrostatic charge image developer according to the exemplary embodiment is used.

The image forming method according to the exemplary embodiment include a charging process of charging at least a surface of an image holding member, an exposure process of forming an electrostatic latent image on the surface of the image holding member, a developing process of developing the electrostatic latent image formed on the surface of the image holding member with an electrostatic charge image developer to form a toner image, a transfer process of transferring the toner image formed on the surface of the image holding member onto a surface of a transfer medium, and a fixing process of fixing the toner image. As the electrostatic charge image developer, the electrostatic charge image developer according to the exemplary embodiment is used.

As the image forming apparatus according to the exemplary embodiment, well-known image forming apparatuses such as a direct transfer type image forming apparatus which directly transfers a toner image formed on the surface of an image holding member onto a recording medium; an intermediate transfer type image forming apparatus which primarily transfers a toner image formed on the surface of an image holding member onto the surface of an intermediate transfer member and secondarily transfers the toner image transferred on the surface of the intermediate transfer member onto the surface of a recording medium; an image forming apparatus including a cleaning unit which cleans the surface of an image holding member before charged and after a toner image is transferred; and an image forming apparatus including an erasing unit which erases a charge from the surface of an image holding member before charged and after a toner image is transferred, by irradiating the surface with easing light may be used.

In the case of an intermediate transfer type image forming apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to the exemplary embodiment and is provided with a developing unit is suitably used.

Hereinafter, an example of the image forming apparatus according to this exemplary embodiment will be shown. However, the image forming apparatus is not limited thereto. Main parts shown in the drawing will be described, but descriptions of other parts will be omitted.

FIG. 1 is a schematic configuration view showing an image forming apparatus according to the exemplary embodiment.

The image forming apparatus shown in FIG. 1 includes first to fourth electrophotographic image forming units (image forming units) 10Y, 10M, 10C, and 10K which output images of the respective colors including yellow (Y), magenta (M), cyan (C), and black (K) according to color-separated image data. These image forming units (hereinafter, also referred to simply as "units" in some cases) 10Y, 10M, 10C and 10K are disposed horizontally in a line with predetermined distances therebetween. Incidentally, each of these units 10Y, 10M, 10C and 10K may be a process cartridge which is detachable from the image forming apparatus.

An intermediate transfer belt 20 is provided through each unit as an intermediate transfer member extending above each of the units 10Y, 10M, 10C and 10K in the drawing. The intermediate transfer belt 20 is provided around a drive roller 22 and a support roller 24 in contact with the inner surface of the intermediate transfer belt 20, which are disposed to be separated from each other from left to right in the drawing. The intermediate transfer belt 20 travels in a direction from the first unit 10Y to the fourth unit 10K. Incidentally, the support roller 24 is pushed in a direction away from the drive roller 22 by a spring or the like (not shown), such that tension is applied to the intermediate transfer belt 20 which is provided around the support roller 24 and the drive roller 22. Also, on the surface of the image holding member side of the intermediate transfer belt 20, an intermediate transfer member cleaning device 30 is provided to face the drive roller 22.

In addition, toners including toners of four colors of yellow, magenta, cyan and black, which are accommodated in toner cartridges 8Y, 8M, 8C and 8K, respectively, are supplied to developing devices (developing units) 4Y, 4M, 4C and 4K of each of the units 10Y, 10M, 10C and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example. In addition, the same components as those of the first unit 10Y are represented by reference numerals to which the symbols M (magenta), C (cyan), and K (black) are attached instead of the symbol Y (yellow), and the descriptions of the second to fourth units 10M, 10C, and 10K, will be omitted.

The first unit 10Y includes a photoreceptor 1Y functioning as the image holding member. In the vicinity of the photoreceptor 1Y, a charging roller 2Y (an example of the charging unit) for charging the surface of the photoreceptor 1Y to a predetermined potential, an exposure device 3 (an example of the electrostatic charge image forming unit) for exposing the charged surface to a laser beam 3Y based on a color-separated image signal to form an electrostatic charge image, the developing device 4Y (an example of the developing unit) for supplying a charged toner into the electrostatic charge image to develop the electrostatic charge image, a primary transfer roller 5Y (an example of the primary transfer unit) for transferring the developed toner image onto the intermediate transfer belt 20, and a photoreceptor cleaning device 6Y (an example of the cleaning unit) for removing the toner remaining on the surface of the photoreceptor 1Y after the primary transfer are disposed in this order.

The primary transfer roller 5Y is disposed inside the intermediate transfer belt 20 and provided opposite to the photoreceptor 1Y. Furthermore, bias power supplies (not shown), which apply primary transfer biases, are respectively connected to the respective primary transfer rollers 5Y, 5M, 5C and 5K. A controller (not shown) controls the respective bias power supplies to change the transfer biases which are applied to the respective primary transfer rollers.

Hereinafter, the operation of forming a yellow image in the first unit 10Y will be described.

First, before the operation, the surface of the photoreceptor 1Y is charged to a potential of −600 V to −800 V by the charging roller 2Y.

The photoreceptor 1Y is formed by stacking a photosensitive layer on a conductive substrate (for example, volume resistivity at 20° C.: $1\times10^{-6}$ Ω·cm or lower). In general, the photosensitive layer has high resistance (resistance similar to that of general resin), but has properties in which, when irradiated with the laser beam 3Y, the specific resistance of a portion irradiated with the laser beam changes. Thus, the laser beam 3Y is output to the charged surface of the photoreceptor 1Y through the exposure device 3 in accordance with yellow image data sent from the controller (not shown). The photosensitive layer on the surface of the photoreceptor 1Y is irradiated with the laser beam 3Y. As a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charge flows on the surface of the photoreceptor 1Y and, in contrast, when the charge remains in a portion which is not irradiated with the laser beam 3Y as a toner image.

The electrostatic charge image formed on the surface of the photoreceptor 1Y is rotated to a predetermined development position along with the travel of the photoreceptor 1Y. At this development position, the electrostatic charge image on the photoreceptor 1Y is visualized (developed) by the developing device 4Y.

The developing device 4Y accommodates, for example, an electrostatic charge image developer containing at least a yellow toner and a carrier. The yellow toner is frictionally charged by being stirred in the developing device 4Y to have a charge with the same polarity (negative polarity) as that of a charge on the photoreceptor 1Y and is maintained on a developer roller (an example of the developer holding member). When the surface of the photoreceptor 1Y passes through the developing device 4Y, the yellow toner is electrostatically attached to a latent image portion on the surface of the photoreceptor 1Y from which the charge is erased, and the latent image is developed with the yellow toner. The photoreceptor 1Y on which a yellow toner image is formed subsequently travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a (+) polarity opposite to the polarity (−) of the toner. For example, the first unit 10Y is controlled to +10 μA by the controller (not shown).

On the other hand, the toner remaining on the photoreceptor 1Y is removed and collected by the photoreceptor cleaning device 6Y.

Also, primary transfer biases to be applied respectively to the primary transfer rollers 5M, 5C and 5K of the second unit 10M and subsequent units are controlled similarly to the primary transfer bias of the first unit.

In this manner, the intermediate transfer belt 20 having a yellow toner image transferred thereonto in the first unit 10Y is sequentially transported through the second to fourth units 10M, 10C and 10K, and toner images of respective colors are superposed and multi-transferred.

The intermediate transfer belt 20 having the four toner images multi-transferred thereonto through the first to fourth units arrives at a secondary transfer portion which is configured with the intermediate transfer belt 20, the support roller 24 in contact with the inner surface of the intermediate transfer belt and a secondary transfer roller 26 (an example of the secondary transfer unit) disposed on the side of the image holding surface of the intermediate transfer belt 20. Meanwhile, a recording sheet P (an example of the recording medium) is supplied to a gap at which the secondary transfer roller 26 and the intermediate transfer belt 20 are in contact with each other at a predetermined timing through a supply mechanism and a secondary transfer bias is applied to the support roller 24. The transfer bias applied at this time has the same (−) polarity as the polarity (−) of the toner, and an electrostatic force directing from the intermediate transfer belt 20 toward the recording sheet P acts upon the toner image, so that the toner image on the intermediate transfer belt 20 is transferred onto the recording sheet P. Incidentally, at this time, the secondary transfer bias is determined according to the resistance detected by a resistance detecting unit (not shown) for detecting a resistance of the secondary transfer portion, and the voltage is controlled.

Then, the recording sheet P is sent to a press contact portion (nip portion) of a pair of fixing rollers in a fixing device 28 (an example of the fixing unit), and the sent toner image is fixed onto the recording sheet P to forma fixed image.

Examples of the recording sheet P onto which the toner image is transferred include plain paper used for electrophotographic copying machines, printers and the like. As the recording medium, other than the recording sheet P, OHP sheets may be used.

In order to improve the smoothness of the image surface after the fixing, the surface of the recording sheet P is preferably smooth, and for example, coated paper in which the surface of plain paper is coated with a resin and the like, art paper for printing and the like are suitably used.

The recording sheet P in which fixing of a color image is completed is transported to an ejection portion, and a series of the color image formation operations is completed.

Process Cartridge and Toner Cartridge

A process cartridge according to the exemplary embodiment will be described.

The process cartridge according to the exemplary embodiment includes a developing unit, which accommodates the electrostatic charge image developer according to the exemplary embodiment and develops an electrostatic charge image formed on the surface of an image holding member as a toner image with the electrostatic charge image developer, and is detachable from the image forming apparatus.

In addition, the configuration of the process cartridge according to the exemplary embodiment is not limited thereto and may include a developing device and, additionally, at least one selected from other units such as an image holding member, a charging unit, an electrostatic charge image forming unit and a transfer unit, if necessary.

Hereinafter, an example of the process cartridge according to the exemplary embodiment will be shown and the process cartridge is not limited thereto. Main parts shown in the drawing will be described and the descriptions of other parts will be omitted.

Figure 2:
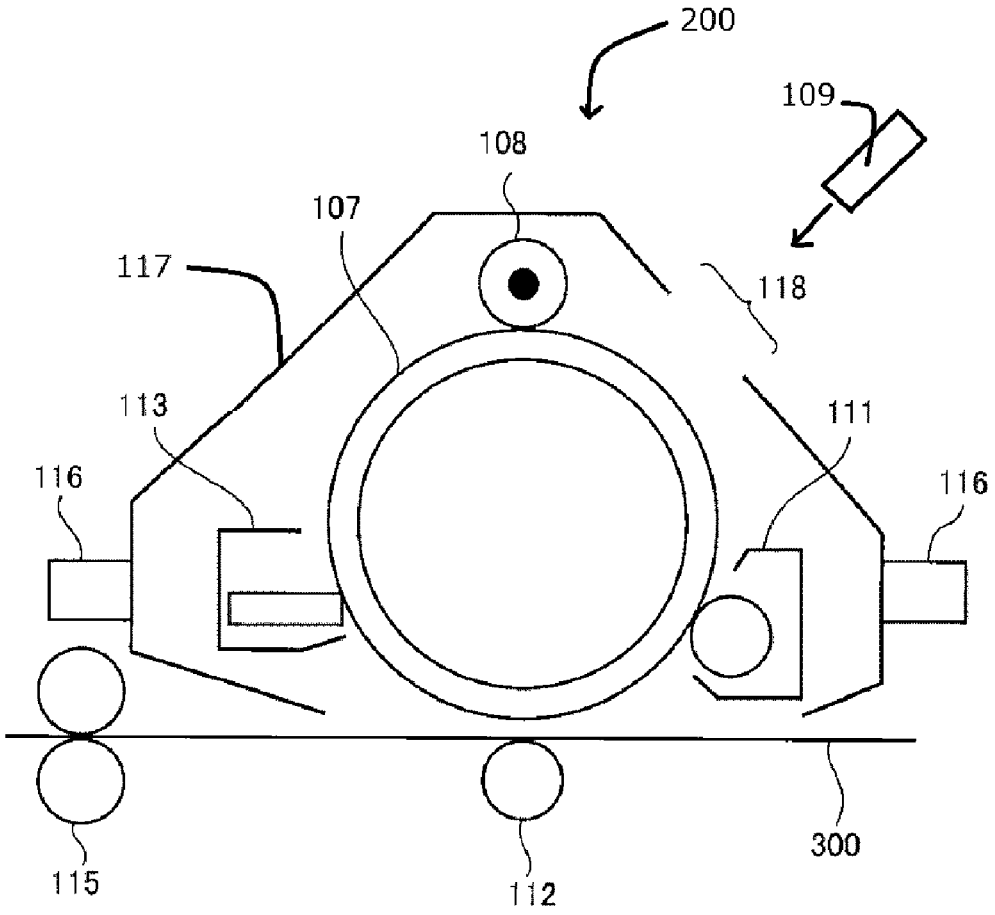
FIG. 2 is a schematic configuration view showing an example of a process cartridge suitably used in an exemplary embodiment.

FIG. 2 is a schematic configuration view showing a process cartridge according to an exemplary embodiment.

A process cartridge 200 shown in FIG. 2 includes, a photoreceptor 107 (an example of the image holding member), a charging roller 108 (an example of the charging unit) provided in the periphery of the photoreceptor 107, a developing device 111 (an example of the developing unit) and a photoreceptor cleaning device 113 (an example of the cleaning unit), all of which are integrally combined and supported, for example, by a housing 117 provided with a mounting rail 116 and an opening portion 118 for exposure to form a cartridge.

Then, in FIG. 2, 109 denotes an exposure device (an example of the electrostatic charge image forming unit), 112 denotes a transfer device (an example of the transfer unit), 115 denotes a fixing device (an example of the fixing unit), and 300 denotes a recording sheet (an example of the recording medium).

Next, a toner cartridge according to the exemplary embodiment will be described.

The toner cartridge according to the exemplary embodiment is a toner cartridge which accommodates the toner according to the exemplary embodiment therein and is detachable from the image forming apparatus. The toner cartridge accommodates the toner for replenishment in order to supply the toner to the developing unit provided in the image forming apparatus.

The image forming apparatus shown in FIG. 1 is an image forming apparatus having a configuration in which the toner cartridges 8Y, 8M, 8C and 8K are detachable, and the developing devices 4Y, 4M, 4C, and 4K are connected to toner cartridges corresponding to the respective developing devices (colors) via a toner supply pipe (not shown). Also, in the case where the toner accommodated in the toner cartridge runs low, the toner cartridge is replaced.

EXAMPLES

Hereinafter, the exemplary embodiment will be described in more detail based on examples but the exemplary embodiment is not limited to these examples. In the following description, unless specified otherwise, "part(s)" represents "part(s) by weight".

Preparation of Coating Resin Particles 1

A solution obtained by dissolving 0.2 parts by weight of an anionic surfactant (NEOGEN SC: linear dodecylbenzene sulfonate, manufactured by Dai-ichi Kogyo Seiyaku Co., Ltd.) in 400 parts by weight of ion exchange water is slowly mixed in a flask with 100 parts by weight of a cyclohexyl methacrylate monomer, and 50 parts by weight of ion exchange water in which 0.2 parts by weight of an initiator (ammonium persulfate) is dissolved is added to the mixture while stirring over 10 minutes to perform emulsion polymerization in the flask. After nitrogen substitution is carried out, the contents are heated to 70° C. using an oil bath while stirring in the flask, and emulsion polymerization is continued for 5 hours. The volume average particle diameter of the obtained resin particles is measured using a laser diffraction particle diameter distribution measuring device (for example, LA-700, manufactured by Horiba, Ltd.), and cumulative distributions of the volume from the small diameter side with respect to the particle diameter range (channel) divided based on the obtained particle diameter distribution are drawn. The particle diameter corresponding to 50% cumulation with respect to the entire particles is measured as a volume average particle diameter $D_{50v}$. As a result, Coating resin particle dispersion 1 in which coating resin particles having a volume average particle diameter of 410 nm are dispersed is obtained. Coating resin particle dispersion 1 is freeze-dried to obtain Coating resin particles 1. The weight average molecular weight of Coating resin particles 1 is measured using a HLC-8120GPC, SC-8020 apparatus, manufactured by Tosoh Corporation, and tetrahydrofuran (THF) as an eluent, in terms of standard styrene molecular weight. The weight average molecular weight is 360,000.

Preparation of Coating Resin Particles 2 to 12

Coating resin particles 2 to 12 are prepared in the same manner as in the preparation of Coating resin particles 1 except that the type of monomer, the type of surfactant, the amount of surfactant to be added, and the amount of initiator are changed as shown in Table 1.

The details of abbreviation in Table 1 other than the above mentioned are as follows.

SS-40N: Anionic surfactant sodium stearate; manufactured by Kao Corporation

TABLE 1

| Coating resin particles | Type of monomer | Surfactant | Amount of surfactant (% by weight) | Initiator | Amount of initiator (% by weight) | Weight average molecular weight |
|---|---|---|---|---|---|---|
| 1 | Cyclohexyl methacrylate | NEOGEN SC | 0.2 | Ammonium persulfate | 0.2 | 360,000 |
| 2 | Cyclohexyl methacrylate | NEOGEN SC | 0.5 | Ammonium persulfate | 0.2 | 310,000 |
| 3 | Cyclohexyl methacrylate | NEOGEN SC | 1.5 | Ammonium persulfate | 0.45 | 280,000 |
| 4 | Cyclohexyl methacrylate | NEOGEN SC | 1.2 | Ammonium persulfate | 0.45 | 250,000 |
| 5 | Cyclohexyl methacrylate | NEOGEN SC | 0.1 | Ammonium persulfate | 0.2 | 320,000 |

TABLE 1-continued

| Coating resin particles | Type of monomer | Surfactant | Amount of surfactant (% by weight) | Initiator | Amount of initiator (% by weight) | Weight average molecular weight |
|---|---|---|---|---|---|---|
| 6 | Cyclohexyl methacrylate | NEOGEN SC | 0.08 | Ammonium persulfate | 0.2 | 380,000 |
| 7 | Methy methacry-late/styrene (50:50) | NEOGEN SC | 0.5 | Ammonium persulfate | 0.2 | 360,000 |
| 8 | Cyclohexyl methacrylate | NEOGEN SC | 0.2 | Sodium persulfate | 0.2 | 320,000 |
| 9 | Cyclohexyl methacrylate | NEOGEN SC | 0.2 | Ammonium persulfate | 1 | 180,000 |
| 10 | Cyclohexyl methacrylate | SS-40N | 0.6 | Ammonium persulfate | 0.2 | 450,000 |
| 11 | Cyclohexyl methacrylate | NEOGEN SC | 0.1 | Ammonium persulfate | 0.6 | 220,000 |
| 12 | Cyclohexyl methacrylate | NEOGEN SC | 0.5 | Ammonium persulfate | 0.2 | 360,000 |

Example 1

Preparation of Carrier 1

Ferrite particles (Mn—Mg ferrite, true specific gravity: 4.7 g/cm$^3$, volume average particle diameter: 40 μm, saturation magnetization: 60 emu/g, surface roughness: 1.5 μm): 100 parts by weight Coating resin particles 1: 2.0 parts by weight Thermosetting resin particles: 0.5 parts by weight (EPOSTAR S: melamine resin particles 200 nm, manufactured by NIPPON SHOKUBAI CO., LTD.)

Carbon Black: 0.5 parts by weight

The above materials are put into a 5 L HENSCHEL MIXER (manufactured by NIPPON COKE & ENGINEERING CO., LTD.) and mixed at 2,000 rpm for 60 minutes to allowing the coating resin particles adhere to the ferrite particles. The temperature of the HENSCHEL MIXER is maintained at 210° C. and stirring is carried out at 2,000 rpm for 20 minutes. Then, while rotating at 1,000 rpm, the mixture is cooled to 50° C. to obtain a coating layer forming carrier. The coating layer forming carrier is sieved with a sieve having an opening of 75 μm to obtain Carrier 1.

Preparation of Externally Added Toner 1

A mixture of 100 parts of a styrene-butyl acrylate copolymer (weight average molecular weight Mw=150,000, copolymerization ratio: 80:20), 5 parts of carbon black (MOGAL L: manufactured by Cabot Corporation), and 6 parts of carnauba wax is kneaded with an extruder, pulverized with a jet mill, and then spheroidized by hot air with CRIPTRON (manufactured by Kawasaki Heavy Industries, Ltd.). Then, the particles are classified with a wind classifier to obtain toner particles having a volume average particle diameter of 6.2 μm.

100 parts by weight of toner particles, 1.2 parts by weight of silicone oil-treated silica particles having a volume average particle diameter of 40 nm (RY50: manufactured by Nippon Aerosil Co., Ltd.), and 1.5 parts by weight of hexamethyldisilazane (HMDS)-treated silica particles having a volume average particle diameter of 150 nm are mixed with a sample mill to obtain Externally added toner 1.

Externally added toner 1: 8 parts by weight and Carrier 1: 100 parts by weight are stirred using a V blender at 40 rpm for 20 minutes, and sieved using a sieve having an opening of 125 μm to obtain Developer 1. A carrier is separated from Developer 1 and the weight reduction amount thereof at a temperature in a range of from 120° C. to 180° C. is measured. The weight reduction amount is 0.005% by weight.

Evaluation of Carrier and Developer

After being stored for 1 week in a low temperature and low humidity environment of 5° C. and 15% RH, Developer 1 above is used to print a 5% printing chart by a modified machine of Docu Centre Color 500 manufactured by Fuji Xerox Co., Ltd. The printing is carried out on the initial sheet (first sheet), 10th sheet, 100th sheet, 1,000th sheet, and 10,000th sheet, and the printing density is measured using X-RITE 939 (manufactured by X-Rite Inc.) to carry out printing density evaluation. The obtained results are shown in Table 3.

In the column of "determination" in Table 3, evacuation results are shown based on the following evaluation criteria.

A: The initial printing density is 1.30 or more and the printing density hardly changes up to 10,000 sheets.

B: The initial printing density is 1.25 or more and a change in the printing density up to 10,000 sheets is observed but is a level at which there is no problem.

C: The initial printing density is 1.25 or less and a remarkable change in the printing density up to 10,000 sheets is observed.

After the evaluation is completed, the developer is further stored for 24 hours in a high temperature and high humidity environment of 35° C. and 85% RH and then 5% printing chart is printed. The printing is carried out on the initial sheet (first sheet), and 10,000th sheet and the printing density is measured using X-RITE 939 (manufactured by X-Rite Inc.) to carry out printing density evaluation. The obtained results are shown in Table 3.

In the column of "determination" in Table 3, evaluation results are shown based on the following evaluation criteria.

A: The difference in printing density between the initial sheet and 10,000th sheet is 0.1 or less and thus, the variation is small.

B: The difference in printing density between the initial sheet and 10,000th sheet is from 0.1 to 0.15 and thus, variation is observed but is a level at which there is no problem.

C: The difference in printing density between the initial sheet and 10,000th sheet is 0.15 or more and thus, variation is large.

Examples 2 to 8

Carriers 2 to 8 and Developers 2 to 8 shown in Table 2 are prepared and evaluated in the same manner as in Example 1 except that Coating resin particles 1 are changed to Coating resin particles 2 to 8. The obtained results are shown in Table 3.

Example 9

Preparation of Coating Layer Forming Solution

Coating resin particles 1: 2.0 parts by weight

Toluene: 8.0 parts by weight

Thermosetting resin particles: 0.5 parts by weight (EPOSTAR S: melamine resin particles 200 nm, manufactured by NIPPON SHOKUBAI CO., LTD.)

Carbon black: 0.5 parts by weight

The above materials are stirred and dispersed with a sand mill for 30 minutes to obtain Coating layer forming solution 1.

Preparation of Carrier 9

Ferrite particles (Mn—Mg ferrite, true specific gravity: 4.7 g/cm$^3$, volume average particle diameter: 40 μm, saturation magnetization: 60 emu/g, surface roughness: 1.5 μm): 100 parts by weight Coating Layer Forming Solution 1: 11 Parts by Weight The ferrite particles (magnetic particles) and Coating layer forming solution 1 are put into a kneader and heated to 60° C. Then, while the temperature is maintained at 60° C., stirring is carried out for 10 minutes and then the pressure is reduced to remove toluene. Further, the mixture is heated to 70° C. and the pressure is reduced to distill away toluene. The resin coating layer forming carrier is sieved with a sieve having an opening of 75 μm to thereby obtain Carrier 9, and using Carrier 9, Developer 9 shown in Table 2 is prepared and evaluated. The obtained results are shown in Table 3.

Comparative Examples 1 to 3

Carriers 10 to 12 and Developers 10 to 12 shown in Table 2 are prepared and evaluated in the same manner as in Example 1 except that Coating resin particles 1 in Example 1 are changed to Coating resin particles 9 to 11. The obtained results are shown in Table 3.

Comparative Example 4

Ferrite particles (Mn—Mg ferrite, true specific gravity: 4.7 g/cm$^3$, volume average particle diameter: 40 μm, saturation magnetization: 60 emu/g, surface roughness: 1.5 μm): 100 parts by weight Coating layer forming resin particles 11: 2.0 parts by weight Charge adjusting thermosetting resin particles: 0.5 parts by weight (EPOSTAR S: melamine resin particles 200 nm, manufactured by NIPPON SHOKUBAI CO., LTD.)

The above materials are put into a HENSCHEL MIXER (manufactured by NIPPON COKE & ENGINEERING CO., LTD.) and mixed at 2,000 rpm for 60 minutes to allowing the coating resin particles firmly adhere to the ferrite particles. The temperature of the HENSCHEL MIXER is maintained at 100° C. and stirring is carried out at 2,000 rpm for 20 minutes. Then, while rotating at 1,000 rpm, mixture is cooled to 50° C. to obtain a coating layer forming carrier. The coating layer forming carrier is sieved with a sieve having an opening of 75 μm to obtain Carrier 13. The obtained results are shown in Table 2. Developer 13 is prepared in the same manner as in Example 1 and evaluated. The obtained results are shown in Table 3.

TABLE 2

| | Developer | Carrier | Sulfate ion concentration (% by weight) | B/A | Volume average particle diameter of coating resin particles (nm) | Weight reduction amount (% by weight) | Toner |
|---|---|---|---|---|---|---|---|
| Example 1 | 1 | 1 | 0.02 | 0.27 | 410 | 0.005 | 1 |
| Example 2 | 2 | 2 | 0.02 | 0.48 | 240 | 0.004 | 1 |
| Example 3 | 3 | 3 | 0.04 | 0.55 | 40 | 0.005 | 1 |
| Example 4 | 4 | 4 | 0.04 | 0.49 | 60 | 0.006 | 1 |
| Example 5 | 5 | 5 | 0.02 | 0.15 | 480 | 0.003 | 1 |
| Example 6 | 6 | 6 | 0.01 | 0.12 | 540 | 0.002 | 1 |
| Example 7 | 7 | 7 | 0.02 | 0.48 | 250 | 0.006 | 1 |
| Example 8 | 8 | 8 | 0.02 | 1.05 | 390 | 0.004 | 1 |
| Example 9 | 9 | 9 | 0.04 | 0.26 | 410 | 0.012 | 1 |
| Comparative Example 1 | 10 | 10 | 0.08 | 0.08 | 410 | 0.004 | 1 |
| Comparative Example 2 | 11 | 11 | 0.02 | 1.24 | 190 | 0.008 | 1 |
| Comparative Example 3 | 12 | 12 | 0.04 | 0.06 | 450 | 0.002 | 1 |
| Comparative Example 4 | 13 | 13 | 0.06 | 0.48 | 250 | 0.013 | 1 |

TABLE 3

| | Printing density | | | | | | | |
|---|---|---|---|---|---|---|---|---|
| | Under low temperature and low humidity condition | | | | | | Under high temperature and high humidity condition | |
| Amount of printing (sheets) | Printing density: Initial sheet | 10th | 100th | 1,000th | 10,000th | Determination | Density difference | Determination |
| Example 1 | 1.30 | 1.33 | 1.32 | 1.33 | 1.33 | A | 0.05 | A |
| Example 2 | 1.31 | 1.33 | 1.33 | 1.34 | 1.35 | A | 0.05 | A |
| Example 3 | 1.28 | 1.32 | 1.33 | 1.34 | 1.32 | B | 0.08 | A |
| Example 4 | 1.30 | 1.33 | 1.32 | 1.33 | 1.33 | A | 0.07 | A |

TABLE 3-continued

| | Printing density | | | | | | | |
|---|---|---|---|---|---|---|---|---|
| | Under low temperature and low humidity condition | | | | | | Under high temperature and high humidity condition | |
| Amount of printing (sheets) | Printing density: Initial sheet | 10th | 100th | 1,000th | 10,000th | Determination | Density difference | Determination |
| Example 5 | 1.31 | 1.32 | 1.33 | 1.35 | 1.34 | A | 0.07 | A |
| Example 6 | 1.27 | 1.31 | 1.32 | 1.33 | 1.35 | B | 0.07 | A |
| Example 7 | 1.28 | 1.32 | 1.33 | 1.33 | 1.33 | B | 0.05 | A |
| Example 8 | 1.29 | 1.31 | 1.33 | 1.33 | 1.34 | B | 0.11 | B |
| Example 9 | 1.26 | 1.29 | 1.32 | 1.33 | 1.33 | B | 0.10 | B |
| Comparative Example 1 | 1.10 | 1.20 | 1.30 | 1.33 | 1.33 | C | 0.15 | C |
| Comparative Example 2 | 1.20 | 1.24 | 1.32 | 1.33 | 1.33 | C | 0.11 | B |
| Comparative Example 3 | 1.20 | 1.22 | 1.33 | 1.32 | 1.34 | C | 0.12 | B |
| Comparative Example 4 | 1.12 | 1.22 | 1.30 | 1.33 | 1.35 | C | 0.10 | B |

As seen from the results of Examples 1 to 9, the sulfate ion concentration with respect to the total weight of the resin coating layer of the carrier is 0.05% by weight or less, and when the total value of the molar amount of sulfate ions contained and the molar amount of sulfo groups contained per 1 g of the resin coating layer is A mol and the total value of the molar amount of sodium ions contained and the molar amount of potassium ions contained therein is B mol, in the case of satisfying a relationship of $0.1<B/A<0.2$, the sulfate ion concentration is 0.05% by weight or more. Compared with the results of Comparative Examples 1 to 4 in which the value of B/A is not within the above range, the initial printing density may be prevented from being lowered after storage at low temperature and low humidity for a long period of time, and further, variations in printing density under a high temperature and high humidity environment may be prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

magnetic particles; and a resin coating layer which covers the magnetic particles, wherein a sulfate ion concentration of the resin coating layer is 0.05% by weight or less with respect to a total weight of the resin coating layer, and when a total value of a molar amount of sulfate ions contained and a molar amount of sulfo groups contained per 1 g of the resin coating layer is A mol and a molar amount of sodium ions contained per 1 g of the resin coating layer is B mol, a relationship of $0.1<B/A<1.2$ is satisfied.

2. The electrostatic charge image developing carrier according to claim 1, wherein the total value A of the molar amount of sulfate ions contained and the molar amount of sulfo groups contained per 1 g of the resin coating layer and the molar amount B of sodium ions contained satisfy the following expressions:

$$0.001 \text{ mmol}<A<0.01 \text{ mmol and}$$

$$0.001 \text{ mmol}<B<0.01 \text{ mmol.}$$

3. The electrostatic charge image developing carrier according to claim 1, wherein the resin coating layer contains cyclohexyl (meth)acrylate.

4. The electrostatic charge image developing carrier according to claim 1, wherein a shape factor SF1 of the carrier is from 100 to 145.

5. The electrostatic charge image developing carrier according to claim 1, wherein a weight average molar weight of the resin in the resin coating layer is from 180,000 to 380,000.

6. The electrostatic charge image developing carrier according to claim 1, wherein the resin coating layer contains coating resin particles having a volume average particle diameter of 50 nm to 500 nm.

7. The electrostatic charge image developing carrier according to claim 1, wherein a weight reduction amount at a temperature in a range from 120° C. to 180° C. in subjecting the carrier to a thermal weight measurement is 0.01% by weight or less.

8. A method of preparing the electrostatic charge image developing carrier according to claim 1, comprising:

mixing magnetic particles and coating resin particles to thereby obtain a mixture in which the coating resin particles adhere to surfaces of the magnetic particles; and heating the mixture to 150° C. or higher.

9. An electrostatic charge image developer comprising:

the electrostatic charge image developing carrier according to claim 1; and an electrostatic charge image developing toner.

* * * * *